US006889442B2

(12) United States Patent
Bouvier

(10) Patent No.: US 6,889,442 B2
(45) Date of Patent: May 10, 2005

(54) MEASUREMENT DEVICE AND METHOD OF USE WITH CURVES

(76) Inventor: Paul Bouvier, Box 603 - 204Ont., St., St. Schreiber, ON (CA), P0T 2S0

( * ) Notice: Subject to any disclaimer, the term of this patent is extended or adjusted under 35 U.S.C. 154(b) by 13 days.

(21) Appl. No.: 10/394,185

(22) Filed: Mar. 24, 2003

(65) Prior Publication Data

US 2004/0187331 A1 Sep. 30, 2004

(51) Int. Cl.[7] ..... B43L 7/00
(52) U.S. Cl. ..... 33/492; 33/563
(58) Field of Search ..... 33/27.01, 21.1, 33/483, 485, 492, 493, 494, 551, 486, 563, 565, 566

(56) References Cited

U.S. PATENT DOCUMENTS

| | | | | | |
|---|---|---|---|---|---|
| 421,102 | A | * | 2/1890 | Matthews | 33/483 |
| 563,510 | A | * | 7/1896 | Savidge | 33/492 |
| 809,950 | A | * | 1/1906 | Heysinger et al. | 33/494 |
| 1,571,777 | A | * | 2/1926 | Golden | 33/27.01 |
| 2,245,313 | A | * | 6/1941 | Wilhite | 33/563 |
| 2,389,369 | A | * | 11/1945 | Kittleson | 33/494 |
| D157,404 | S | * | 2/1950 | Nowack | 33/563 |
| D163,411 | S | * | 5/1951 | Picken | 33/563 |
| 2,579,664 | A | * | 12/1951 | Gleasman | 33/492 |
| 3,279,075 | A | * | 10/1966 | Mello | 33/563 |
| 3,416,485 | A | * | 12/1968 | Phillips | 33/492 |
| 3,805,390 | A | * | 4/1974 | Craig | 33/494 |
| 5,813,127 | A | * | 9/1998 | Blevins | 33/492 |
| 6,098,301 | A | * | 8/2000 | Kapphahn | 33/492 |
| 6,305,093 | B1 | * | 10/2001 | Venola | 33/492 |

* cited by examiner

*Primary Examiner*—G. Bradley Bennett
(74) *Attorney, Agent, or Firm*—Ryan W. Dupuis; Adrian D. Battison; Michael R. Williams

(57) ABSTRACT

A measurement device is provided for translating the profile of a source curve from a source area to a target area. The device has an elongate body including a plurality of markings at spaced positions therealong and means for locating a point at a working end thereof. The method for translating the profile of a source curve includes providing a header which spans the source curve. The position of a respective one of the markings of the measurement device is marked on the header in association with each of various points along the source curve when the working end is located at the respective one of the various points. Repositioning the header adjacent the target area upon which the curve is to be translated permits the various points to be located in the target area by aligning the markings on the header with a respective one of the markings on the measurement device and tracing a point at the working end of the device. Joining the points traced on the target area forms the translated curve.

16 Claims, 4 Drawing Sheets

MEASUREMENT DEVICE AND METHOD OF USE WITH CURVES

FIELD OF THE INVENTION

The present invention relates to a method of translating the profile of a source curve from a source area to a target area, and more particularly relates to a measurement device suited for use in the method of translating the profile of the source curve to the target area described herein.

BACKGROUND

In various instances it is desirable to reproduce the profile of a curved or irregular surface from a source area to a target area. In one example, in the industry of boat building, it is commonly desirable to fit various panels or members in abutment with concave interior surfaces requiring the profile of the surface to be translated to the member prior to cutting for proper fit therebetween. Typically this is accomplished by obtaining approximate measurements of the largest width end height dimensions required of the member at which point partly fitting the member into the destined area permits further trimming measurements to be taken requiring an additional cutting step in order to properly fit the member against the curved surface. Especially on concave surfaces it is commonly difficult for the unfinished member to be located sufficiently close to the surface upon which it is to be abutted to permit sufficiently accurate measurement for a close finished fit therebetween.

SUMMARY

According to one aspect of the invention there is provided a measurement device comprising:

an elongate body including a plurality of markings at spaced positions therealong; and means for locating a point at a working end of the elongate body.

According to a second aspect of the present invention there is provided a method of translating a source curve to a target area, the method comprising:

providing a header which spans the source curve;

providing a measurement device having an elongate body including a plurality of markings at spaced positions therealong and means for locating a point at a working end of the elongate body;

locating the working end of the elongate body at various points along the curve;

marking a position of a respective one of the markings of the measurement device on the header in association with each of the various points along the curve when the working end is located at the respective one of the various points along the curve;

repositioning the header adjacent the target area upon which the curve is to be translated;

locating each of the various points along the curve by aligning the markings on the header with a respective one of the markings on the measurement device and tracing a point at the working end of the measurement device on the target area;

joining the points traced on the target area to form a translated curve.

The measurement device disclosed herein provides a means for readily measuring between a point located at the working end of the device and a tracer marking spaced along the device. As only tracing is required, no calculations or numerical indicia are required and no recording other than the tracer markings are required. Accordingly the profile of any surface across which a header may span is accomplished readily and accurately by permitting various points to be traced between the header and the surface to be translated regardless of whether the surface profile is concave, convex, irregular, inclined or straight.

The method may include marking indicia on the header in association with each of the positions on the header of the respective markings of the measurement device for each of the various points along the curve, the indicia on the header being indicative of the respective marking on the measurement device.

When the body is formed of flat, flexible material, the method may include flexing the body to follow a path along the points traced on the target area for joining the points by tracing a straight edge of the body spanning between said points.

The working end of the elongate body is preferably pointed for locating a point at the working end. In alternative arrangements, there may be provided a guide aperture or indicia along an edge of the working end of the body for locating a point at the working end.

The plurality of markings preferably comprise notches formed along one side edge of the body at spaced positions in a longitudinal direction of the body which define projections therebetween.

Preferably each notch, or the projections formed therebetween, includes one curved edge and one straight edge which lies perpendicularly to the longitudinal direction of the body.

There may be provided indicia located on the body in association with each notch or projection defined between a pair of notches.

There may be provided ruler markings at evenly spaced positions along one side edge of the elongate body opposite the notches formed therein.

BRIEF DESCRIPTION OF THE DRAWINGS

In the accompanying drawings, which illustrate exemplary embodiments of the present invention.

DETAILED DESCRIPTION

Figure 1:
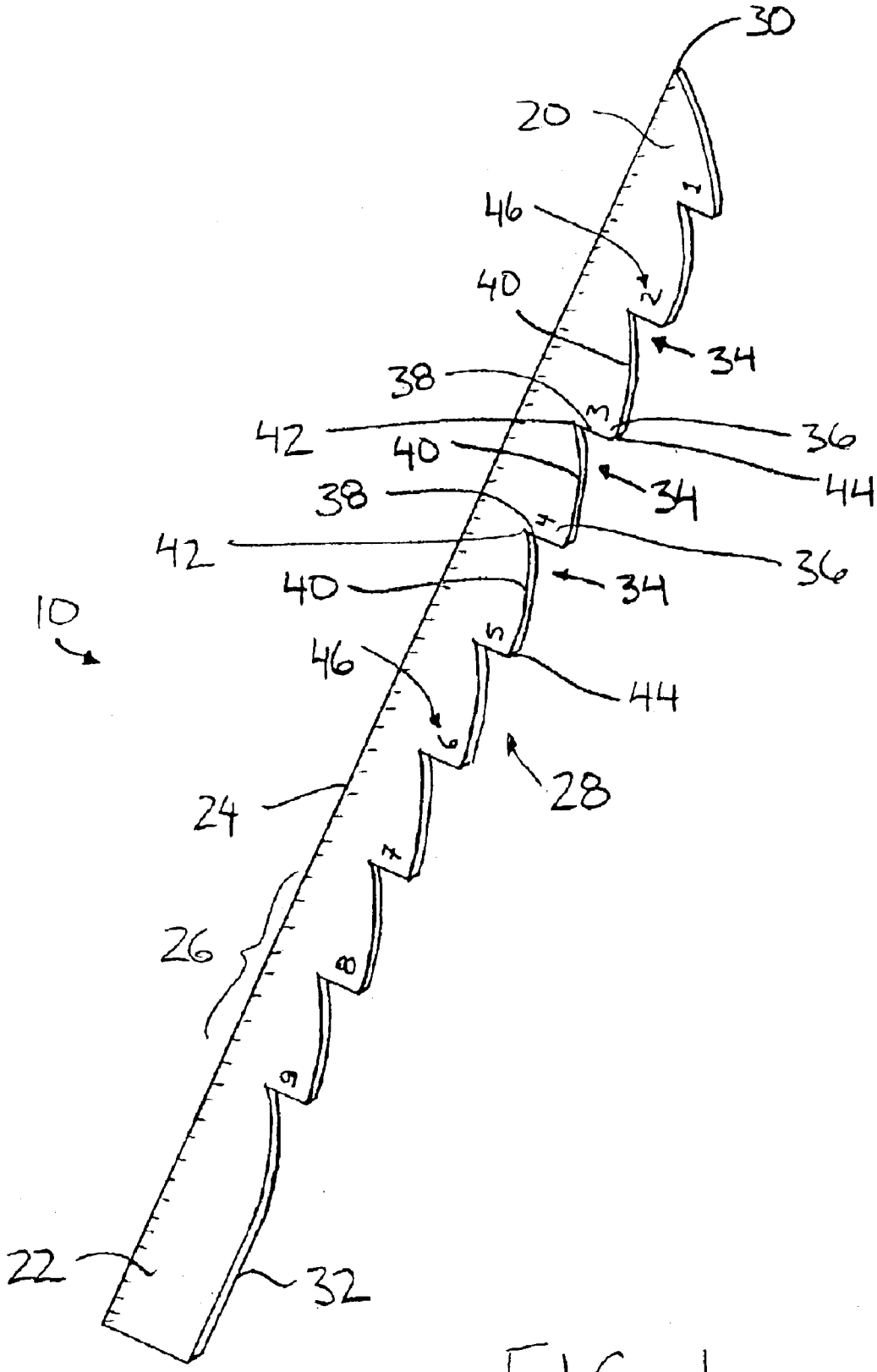
FIG. 1 is a perspective view of the measurement device according to the present invention.
Figure 2:
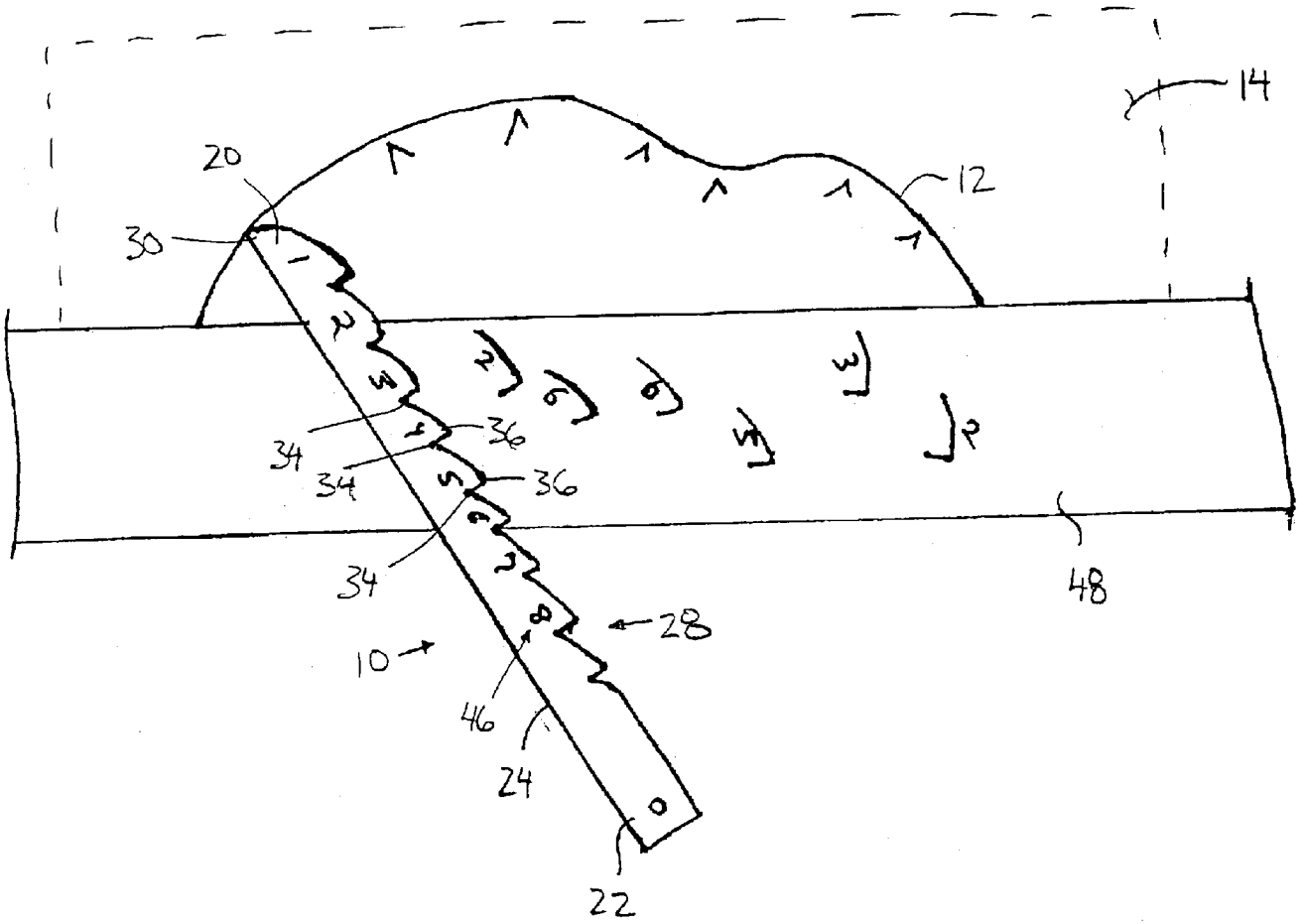
FIG. 2 is a plan view of the device spanning between the header and a source curve to be translated.
Figure 3:
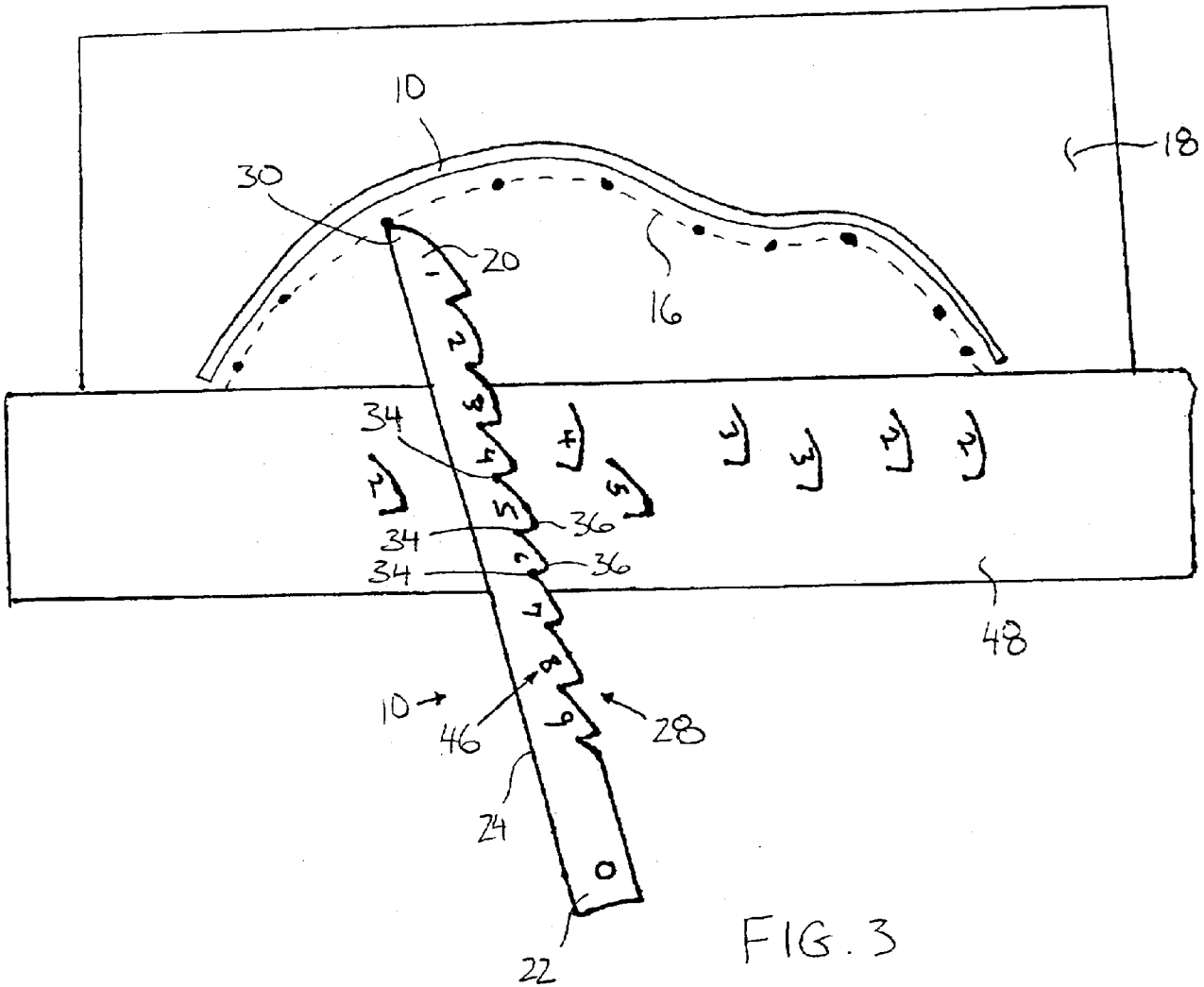
FIG. 3 is a similar plan view to that of FIG. 2 in which the device spans between the header and points traced on a reproduced curve on the target area.
Figure 4:
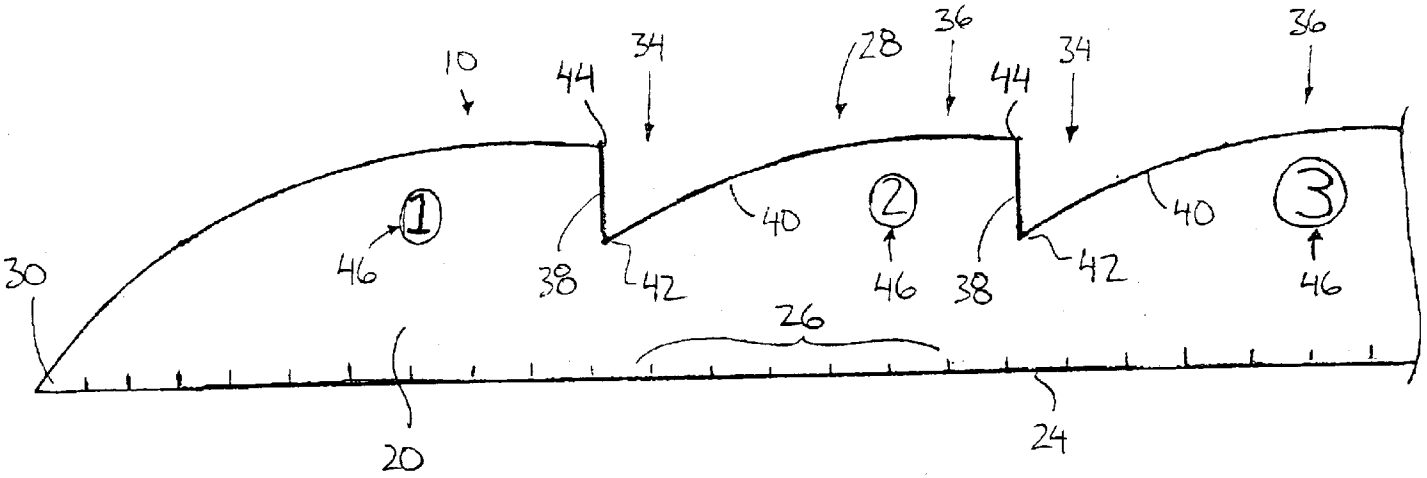
FIG. 4 is an enlarged side elevational view of the working end of the measurement device.

Referring to the accompanying drawings there is illustrated a measurement device generally indicated by reference numeral 10. The device 10 is particularly useful for translating the profile of a source profile 12, for example a curve, from a source area 14 to a reproduced profile 16 at a target area 18.

The device 10 generally includes an elongate body which extends in a longitudinal direction from a working end 20 to a blunt, handle end 22. The body is flat and sufficiently stiff to retain its shape while being permitted to flex into various irregular curved profiles for tracing therealong.

The body includes one straight edge 24 extending in a longitudinal direction which includes a plurality of ruler markings 26 at evenly spaced positions therealong in the longitudinal direction. A tracing edge 28 is provided along an opposite side from the straight edge 24 to similarly extend in the longitudinal direction of the device 10. The tracing edge 28 includes a plurality of tracer markings at evenly longitudinally spaced positions. The tracer edge tapers towards a pointed apex 30 at the straight edge 24 to define a point at the working end 20 of the device. The tracing edge 28 further includes a straight portion 32 at the handle end 22 of the body for comfortably gripping in a person's hand.

The tracer markings each comprise a notch 34 which defines an associated projection 36 adjacent thereto between said notch and an adjacent one of the notches. Each notch includes a leading edge 38 nearer to the working end of the body which is a straight edge lying perpendicularly to the longitudinal direction of the body. Each notch further includes a trailing edge 40 which is nearer to the handle end of the body and is generally in the form of a curved, convex edge which meets the leading edge 38 of the respective notch at an interior apex 42 of the notch. The trailing edge spans from the interior apex 42 of the respective notch to an exterior apex 44 which meets the leading edge 38 of an adjacent notch so as to define a pointed apex at each respective projection 36 defined between the notches.

Accordingly each notch 34 or associated projection 36 includes one curved edge in the form of the trailing edge 40 and one straight perpendicular edge in the form of the leading edge 38 which either meet at a respective interior apex 42 in the case of a notch or at an exterior apex 44 in the case of a projection. Either a notch or a projection may be traced for locating the position of the measurement device on a suitable header in use. Unique indicia 46 associated with the tracer markings respectfully are preferably in the form of sequential numerical references inscribed on one or both flat surfaces of the measurement device 10.

For translating the source profile 12 from the source area 14, a header 48 is provided in the form of a scrap of lumber or a sheet of paper and the like which is of sufficient length to span the length of the source profile 12. By locating the header adjacent the source curve, various measurements between the header and the surface profile are accomplished by locating the pointed working end of the device at plural points along the profile. In each instance when the working end is located at a point on the profile, one of the tracer markings along the tracing edge of the device is traced on the header and the associated one of the indicia 46 is also marked on the header adjacent the traced marking for indicating the exact position of the pointed working end of the device in relation to the header.

To reproduce the profile at the target area 18, the header is positioned adjacent the target area where each of the various points along the curve recorded by the header is retraced on the target area by aligning the appropriate tracer marking of the device at each traced marking on the header so that a point may be traced at the pointed working end of the device. The device may subsequently be flexed to follow along the path of the points traced in the target area with the straight edge 24 being abutted against the target area to permit a reproduced profile 16 to be traced by joining the points traced on the target area 18.

In one embodiment as illustrated in FIGS. 1 through 4, the device may have a length which is in the order of an average ruler for convenience. When the body is suitably sized to be approximately one and a half inches at its widest point at the exterior apex of the respective projections, width at the narrowest point at the interior apexes is arranged to be seven eighths of an inch. In this instance the notches have a spacing of approximately two and three quarter inches in the longitudinal direction.

Figure 5:
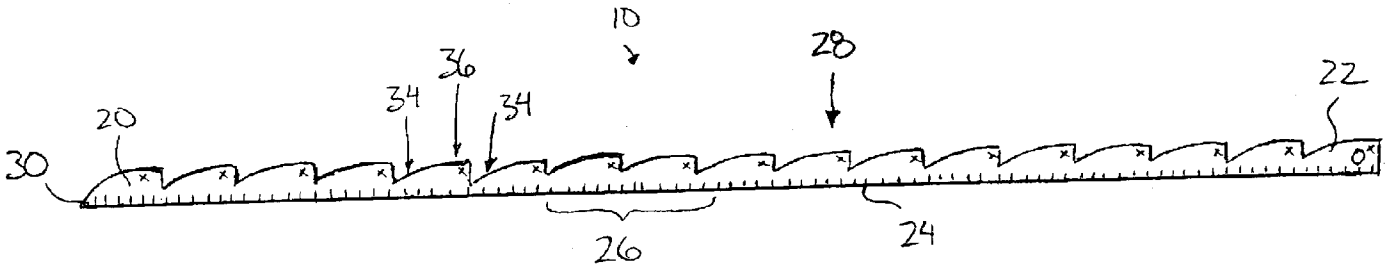
FIG. 5 is a side elevational view of a further embodiment of the measurement device.

In FIG. 5 an alternate embodiment is illustrated in which the device has a length which is comparable to a conventional meter stick or yard stick. In this instance conventional ruler markings for both metric and imperial measurement scales are provided on opposing flat faces of the body of the measurement device.

As noted herein the measurement device provides a convenient stick for copying patterns by measuring and duplicating the profiles of curves or other odd shapes in addition to straight or inclined surfaces as well. The body is preferably formed of rubber or a flexible plastic, similar in construction to conventional yard sticks, but having only one straight edge, the other edge comprising a combination of notches or projections formed of straight and curved edges. The combination of a curved edge and a straight edge associated with each tracer marking is particularly useful for accurately locating the position of the device relative to the header when locating a point at the working end of the device. By providing a straight edge opposite the tracing edge the device can readily be used as a conventional ruler as well. The use of flexible or rubber material for forming the body of the device permits it to be used as a flexible batten as well for tracing the profile of surfaces spanning between points traced on a target area. When using the device to measure the profile of irregular surfaces the spacing of the points measured on the curve are preferably located closer together when sharp changes in the direction of the profile occur but when the profile is straight or of a flatter curve as compared to the sharper curves of the profile, the spacing of the points to be located along the source curve can be increased.

In the boat building industry the reproduced curve can be readily traced onto a panel member to permit the panel to be accurately cut for abutment against interior concave curved surfaces of a boat.

While various embodiments of the present invention have been described in the foregoing, it is to be understood that other embodiments are possible within the scope of the invention. The invention is to be considered limited solely by the scope of the appended claims.

What is claimed is:

1. A measurement device comprising:

an elongate body including a plurality of markings at spaced positions therealong, the plurality of markings comprising notches formed along one side edge of the body at spaced positions in a longitudinal direction of the body wherein each notch includes one curved edge and one straight edge; and means for locating a point at a working end of the elongate body;

wherein there are provided ruler markings at evenly spaced positions along one side edge of the elongate body opposite the notches formed therein.

2. The device according to claim 1 wherein said working end of the elongate body is pointed.

3. The device according to claim 1 wherein each straight edge lies perpendicularly to the longitudinal direction of the body.

4. The device according to claim 1 wherein each adjacent pair of notches defines a projection therebetween, the projection being pointed.

5. The device according to claim 1 wherein there is provided indicia located on the body in association with one edge of each notch.

6. The device according to claim 1 wherein the body is formed of flat, flexible material.

7. A method of translating a source curve to a target area, the method comprising:

providing a header which spans the source curve;

providing a measurement device having an elongate body including a plurality of markings at spaced positions therealong and means for locating a point at a working end of the elongate body;

locating the working end of the elongate body at various points along the curve;

marking a position of a respective one of the markings of the measurement device on the header in association with each of the various points along the curve when the working end is located at the respective one of the various points along the curve;

repositioning the header adjacent the target area upon which the curve is to be translated;

locating each of the various points along the curve by aligning the markings on the header with a respective one of the markings on the measurement device and tracing a point at the working end of the measurement device on the target area;

joining the points traced on the target area to form a translated curve.

8. The method according to claim 7 wherein said working end of the elongate body is pointed.

9. The method according to claim 7 wherein the plurality of markings comprise notches formed along one side edge of the body at spaced positions in a longitudinal direction of the body.

10. The method according to claim 9 wherein each notch includes a curved edge.

11. The method according to claim 9 wherein each notch includes a straight edge lying perpendicularly to the longitudinal direction of the body.

12. The method according to claim 9 wherein each notch includes one curved edge and one straight edge which lies perpendicularly to the longitudinal direction of the body.

13. The method according to claim 9 wherein each adjacent pair of notches defines a projection therebetween, the projection being pointed.

14. The method according to claim 9 wherein there is provided indicia located on the body in association with one edge of each notch.

15. The method according to claim 9 wherein the method includes marking indicia on the header in association with each of the positions on the header of the respective markings of the measurement device for each of the various points along the curve, the indicia on the header being indicative at the respective marking on the measurement device.

16. The method according to claim 7 wherein the body is formed of flat, flexible material and wherein the method includes flexing the body to follow a path along the points traced on the target area for joining the points by tracing a straight edge of the body spanning between said points.

* * * * *